United States Patent [19]

Riley

[11] 4,103,483

[45] Aug. 1, 1978

[54] ELECTRONIC WRISTWATCH

[75] Inventor: George Andrew Riley, Rocky Hill, N.J.

[73] Assignee: RCA Corp., New York, N.Y.

[21] Appl. No.: 319,367

[22] Filed: Dec. 29, 1972

[51] Int. Cl.[2] ..... G04B 37/0;8; G04C 3/00; G04B 19/30

[52] U.S. Cl. ..... 58/90 R; 58/23 R; 58/50 R; 58/55; 58/88 R

[58] Field of Search ..... 58/23 R, 23 A, 23 D, 58/50 R, 53–55, 88 R, 90 R; 174/52 PE; 361/380, 395

[56] References Cited

U.S. PATENT DOCUMENTS

| | | | |
|---|---|---|---|
| 2,260,835 | 10/1941 | Happanen et al. | 58/90 R |
| 2,582,706 | 1/1952 | Kudelski | 58/90 R |
| 2,682,146 | 6/1954 | Wachter | 58/90 R |
| 3,109,880 | 11/1963 | Newby | 174/52 PE |
| 3,129,557 | 4/1964 | Fiechter | 58/90 R |
| 3,485,033 | 12/1969 | Langley | 58/90 R |
| 3,505,804 | 4/1970 | Hofstein | 58/23 |
| 3,508,044 | 4/1970 | Hochberg | 58/50 R |
| 3,545,198 | 12/1970 | Loftus | 58/90 |
| 3,672,155 | 5/1970 | Bergey et al. | 58/50 R |

FOREIGN PATENT DOCUMENTS

| | | | |
|---|---|---|---|
| 2,137,351 | 3/1972 | Fed. Rep. of Germany | 58/50 R |

*Primary Examiner*—Edith S. Jackmon

*Attorney, Agent, or Firm*—H. Christoffersen; Lawrence P. Benjamin

[57] ABSTRACT

A one-piece molded plastic element serves as the sole outer case of an electronic watch. The battery is threaded and screws into one opening in the case. Time setting is accomplished by inserting the ends of a U shaped conductor in other openings in the case. The case is formed with means by which a wrist band may be secured thereto.

8 Claims, 7 Drawing Figures

ELECTRONIC WRISTWATCH

BACKGROUND OF THE INVENTION

A number of watches and clocks have been devised which are entirely electronic in operation, using no moving mechanical parts in the timekeeping or time display functions. A recent one of these uses an oscillating quartz crystal as a frequency standard; counting and decoding circuits convert the crystal output to a form and frequency suitable to operate a display. A typical realization using a liquid crystal display is illustrated in U.S. Pat. No. 3,505,804 by S. R. Hofstein. A commercially available wristwatch uses a display of light emitting diodes. Several all solid-state wristwatches with liquid crystal displays have been announced for retail introduction in the near future.

While the electronic "movements" of these watches are potentially simpler and cheaper than conventional mechanical watches of equivalent accuracy, the outer cases which are used are both more costly and complex. One reason is that electrical switches must be provided to allow setting of the timepiece. These switches are considerably smaller than commercially available switches and their size presents difficulties of manufacture. In addition, they must not compromise the watertight integrity of the case, must lend themselves to attractive styling, and maintain reliability in all the environmental circumstances to which watches are subjected. Consequently, watch cases embodying such switches, are and will continue to be more expensive than conventional watch cases. In addition, labor costs are incurred in assembling such watches, since appropriate connections must be made to each switch. This extra manufacturing operation does not readily lend itself to automated production.

An alternative to conventional mechanical switches may be to use some internal switches activated by nonmechanical means. For example, one commercially available watch uses sealed "reed switches" within the case, actuated by proximity to a small magnet provided with the bracelet. While this is possible, it requires relatively costly and fragile switches, and a unique activating device. A second alternative described in U.S. Pat. No. 3,485,033 to L. W. Langley is to employ a light responsive element located within the watch which may be activated by shining a bright beam of light onto that element. This too appears to be a fairly costly and somewhat inconvenient technique.

SUMMARY OF THE INVENTION

The electrical circuit and electronic display driven by the electrical circuit of an electrooptical wristwatch are housed in a one piece element integral with the circuit and display. This element, which may be a molded plastic, serves as the sole outer case of the wristwatch and is formed with means by which a wrist band may be secured thereto. In a preferred form of the invention, the time may be set by placing the ends of a conductor into openings in the case.

DETAILED DESCRIPTION

Figure 1:
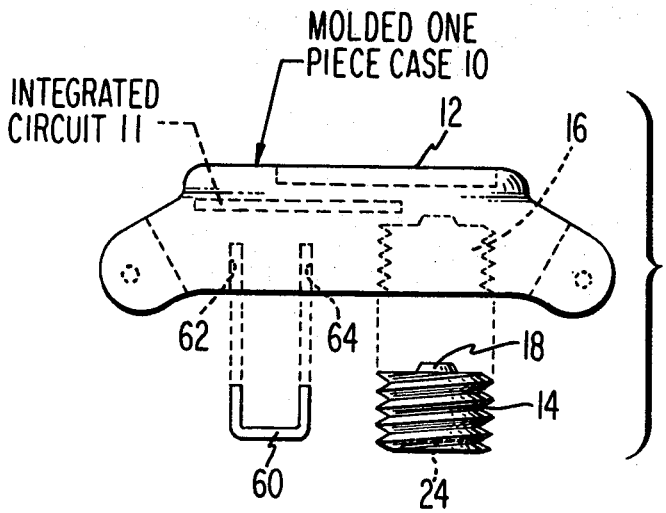
FIG. 1 is a side view of an embodiment of the invention.

The electrical circuit and display of the watch in FIG. 1 are conventional and are discussed, for example, in the Hofstein patent mentioned above and in many other publications and patents. The electrical circuit is preferably an integrated circuit and requires little space. The display is an electrooptical display formed of liquid crystal, or of light emitting diodes, or of electroluminescent elements, or of any one of a number of other alternatives which do not require moving parts. The display may be formed on a separate substrate from the integrated circuit and connected thereto or, alternatively, the display may be formed on one side of a circuit board and the integrated circuit on another and the two joined through plated through holes or in other ways, and other alternatives are also available. All of this is conventional and not part of the present invention.

Figure 2:
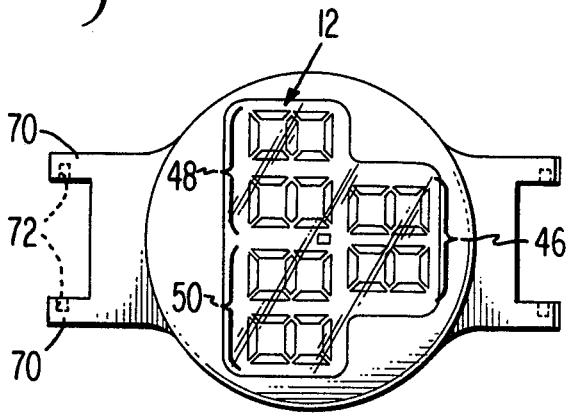
FIG. 2 is a top view of the watch of FIG. 1.

After the assembly process described above, the watch is placed in a mold and encapsulated in a one piece material 10 by flowing this material, in fluid form, into the mold and then causing it to harden. The integrated circuit is shown in phantom view at 11. The display 12, shown most clearly in FIG. 2, may be exposed at one face and in this case assumes the position of the plastic or glass crystal in a conventional watch. Alternatively, if the material of which the watch case is formed is reasonably transparent, the numeric indicators shown may be covered with a film of the material employed to mold the case and this serves as additional protection for the numeric indicators of the display.

The material employed to form the case may be polyethylene, polyurethane, one of the various kinds of epoxies, one of the rubbers or any one of many other forms of moldable material. For convenience, the term "plastic" will be used in the remainder of the description to indicate all of these and other suitable, moldable materials. This material, after suitable treatment and curing, may be either a rigid or a semi-rigid substance. A semi-rigid substance having some resilient properties may be advantageous in offering shock absorbing protection for a wristwatch. In addition, with proper choice of material and treatment thereof, the degree of resiliency may be made such as to permit the wristwatch to flex sufficiently to conform to the shape of the wrist and thus be more comfortable to wear.

Figure 6:
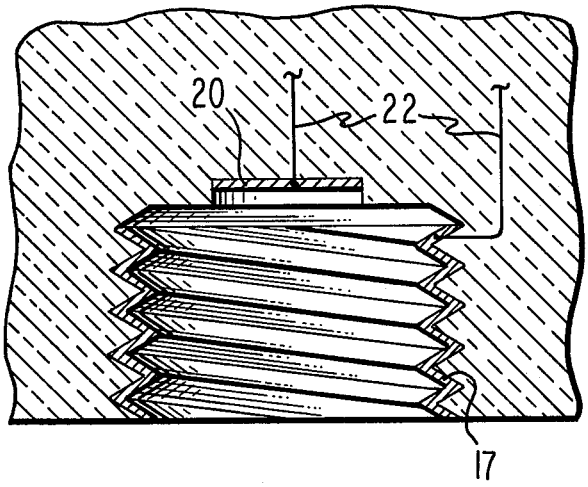
FIG. 6 is another cross section through the watch of FIG. 1, showing in more detail the opening for receiving a battery.

An electronic wristwatch is driven by a battery. The battery is shown at 14 in FIG. 1 and it screws into a threaded opening, shown in phantom view at 16 in FIG. 1. As shown in more detail in FIG. 6, the threaded opening may be formed with a metal shell or coating 17 on its interior threaded surface or, alternatively, with a metal piece opening on said threaded surface, for contacting one terminal of the battery. In the embodiment illustrated, the threaded outer surface of the battery 14 is formed of metal or includes a metal element leading to one of the battery electrodes. The contact for the second terminal 18 of the battery is shown in FIG. 6 at 20 at the bottom of the opening 16. The leads 22 shown extending from the conductors 16 and 20, connect to circuit 11.

The battery 14 may be screwed into place by engaging a screwdriver with the screw opening 24 shown in phantom view in FIG. 1. While not shown, it is to be appreciated than an O-ring or a similar seal may be provided to give the case water tight integrity.

Figure 5:
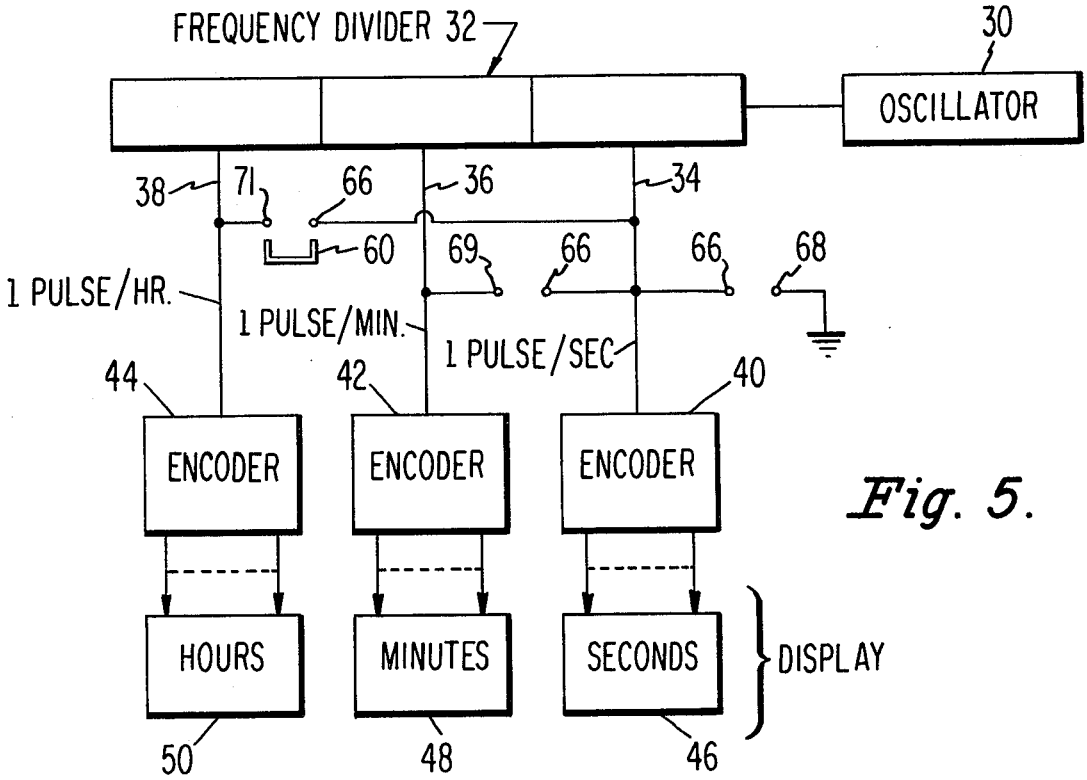
FIG. 5 is a block diagram of the time setting circuit of the watch of FIG. 1.

FIG. 5 illustrates the time setting circuit for the watch of FIG. 1. The watch includes an oscillator 30 which drives a frequency divider 32. The divider may have three output leads 34, 36 and 38 at which pulses of repetition frequencies one pulse per second, one pulse per minute and one pulse per hour, respectively, are produced. The pulses are supplied to encoders 40, 42 and 44 which drive the seconds 46, minutes 48, and hours 50 numeric indicators of the display.

The time setting of the watch may be accomplished first by grounding the seconds lead 34 to place the second indicators at the value "00". When the ground is removed the seconds numeric indicators start up from this point. Next, the lead 34 is connected to the encoder 42 for driving the minutes numeric indicators at the rate of one pulse per second. When these indicators are at the correct value this connection is removed. Next, the same procedure is followed with respect to the hours indicator 50.

The hours indicator may also be set independently, without disturbing the minutes or seconds indicator, by connecting the lead 34 to the encoder 44. This facilitates changing the display when crossing time zones or for daylight saving time.

Figure 3:
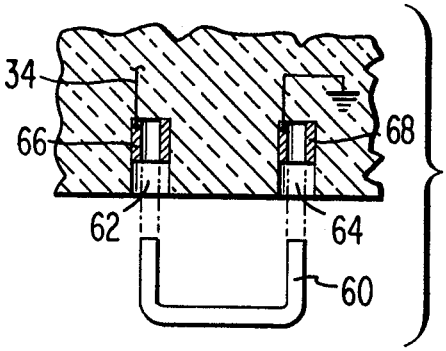
FIG. 3 is a cross section through a portion of the watch showing one feature of the invention.

In the present invention the means for setting time comprises a very simple U shaped element 60 in FIGS. 1, 3 and 5. This U shaped element fits into two openings such as 62, 64 and engages conductive contacts such as the sleeves shown at 66 and 68 in FIG. 3. These contacts and also contacts 69 and 71 connect to the frequency divider output leads as illustrated in FIG. 5. The openings 62 and 64 and so on are on the back of the case and are not visible. This permits complete freedom of styling of the watch.

Figure 4:
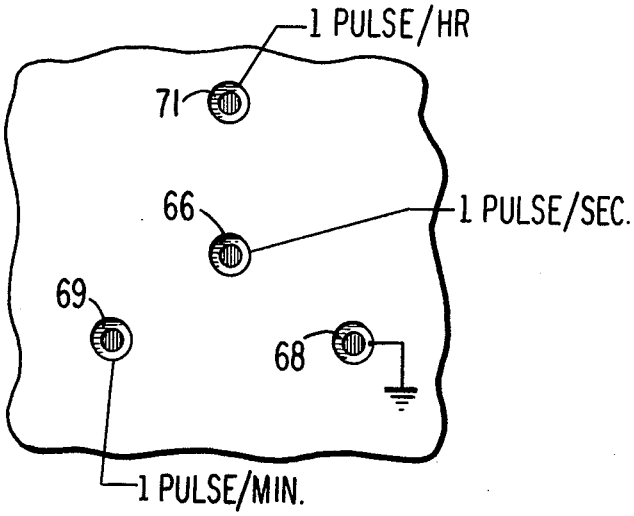
FIG. 4 is a view of a portion of the back of the watch.

The U shaped element is very simple and inexpensive, and if lost can be replaced with a hairpin, paper clip or the like. The only function of this element is to provide a conductive path between the seconds lead 34 and other leads, or ground, as should be clear from FIG. 5. FIG. 4 shows a typical placement of openings for receiving the ends of conductor 60.

As already mentioned, the contacts such as 66 and 68 preferably are located near the bottom of the openings to protect them from accidental short circuits. If desired, these openings may be further protected by a separate plastic element which may be snapped into place or otherwise secured to the back of the watch. This separate plastic element may also be employed to cover the battery. To facilitate the insertion of such an element, the case may be molded in such a way that there is a recessed region in the under surface adapted to receive a thin plastic element which snaps into place.

Figure 7:
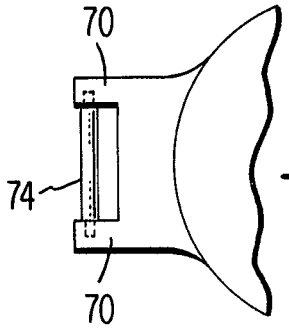
FIG. 7 shows another form of wrist band securing means for the watch on FIG. 1.

The plastic ase of the wristwatch may be formed with ears such as 70 having recesses such as 72 (FIG. 2) for receiving the ends of a spring loaded metal rod conventionally employed for holding a wrist strap in place. Alternatively, the case may be molded with a rod or bar such as 74 of FIG. 7 already in place. The rod itself may be formed of the same plastic as the case but preferably reinforced or even may be a metal pin which is permanently embedded in the ears 70. With this form of structure the strap, of course, should be of the type which passes beneath the back of the case and through the loops formed by the bar 74 and the corresponding bar (not shown) at the other end of the case.

While it is presently contemplated that the battery will be removable from the watch in the manner shown in FIG. 1, if the economics permits, the battery may at some future data be molded into the watch and not be made removable. This assumes that the price of the electronics and display is sufficiently low that when the battery wears out, the entire watch simply may be discarded and replaced with a new one with the fresh battery in place. It also assumes, in the case of a non-rechargeable battery, that the stock quickly will move off the shelf.

I claim:

1. A wristwatch comprising, in combination:

a first element comprising an electrical circuit;

a second element comprising an electrooptical display of time, having a surface at which the time may be observed, said electrical circuit connected to said electrooptical display; and a one piece plastic case and support in intimate contact with the first element over at least a substantial portion of the peripheral surface of said first element and embedding said first element and in intimate contact with a substantial portion of said second element for holding said second element so that its said surface is visible; said case serving as the sole outer case of said wristwatch and serving also as the means for holding the first and second elements immobile with respect to each other without the need for other clamping or holding means, and as the means maintaining them in a desired positional relationship to one another.

2. A wristwatch comprising, in combination:

an electrical circuit an electrooptical display of time driven by said electrical circuit;

a one piece element integral with said circuit and display, housing said electrical circuit and display and serving as the sole outer case of said wristwatch, and formed with means by which a wristband may be secured thereto;

said one-piece element being formed with an opening therein internally threaded to receive a battery which is correspondingly threaded; and conductor means terminating at said opening for engaging the terminals of said battery.

3. A wristwatch as set forth in claim 1, wherein said electrical circuit includes a circuit for producing first and second electrical signals for causing the display to be driven at least at the rates of one unit of time per hour and one unit of time per minute, respectively and includes also a circuit for producing a third signal at a frequency substantially higher than that of said first and second signals, and wherein said case is provided with at least three openings therein, each having a conductor therein, one of the conductors carrying said first signal, the second of the conductors carrying said second signal, and the third of the conductors carrying said third signal, whereby said watch may be set by placing the free ends of a conductor into the openings carrying said first and third conductors to make contact with both of these conductors to set hours, and by placing the free ends of said conductor into the openings carrying said second and third conductors to make contact with both of these conductors to set minutes.

4. An electrically operated wristwatch comprising, in combination:

a case;

an electrooptical display at the front surface of said case having at least an hours indicator and a minutes indicator;

a circuit within the case coupled to said display for driving the same including means for producing a signal at a first frequency for operating the hours indicator and a signal at a second frequency for operating the minutes indicator;

a circuit within the case for producing a time setting signal at a frequency substantially higher than said second frequency;

three openings in the case, each adapted to receive the end of a conductor;

three terminals, one in each opening, the first said terminal carrying said signal at said first frequency, the second said terminal carrying said signal at said second frequency, and the third said terminal carrying said time setting signal; and a generally U shaped conductor mateable with two of said openings at a time, which when it ends are placed in the openings carrying the first and third terminals engages said terminals and causes the time setting signal to be applied to said first terminal and when placed in the openings carrying said second and third terminals engages said terminals and causes said time setting signal to be applied to said second terminal.

5. The combination of claim 4, wherein said case comprises a one piece plastic case and support, said case embedding said circuits and being in intimate contact with said circuits over substantial portions thereof and also being in intimate contact with said display over a substantial portion thereof for holding said display so that its viewing surface is visible and for holding the circuits and element immobile and for maintaining said circuits and display in a desired positional relationship to one another.

6. A wristwatch as set forth in claim 1 wherein said one-piece plastic case is formed with means for securing a wristband thereto.

7. A wristwatch as set forth in claim 1 wherein said one piece element comprises a molded plastic element.

8. A wristwatch as set forth in claim 1 wherein said display comprises a liquid crystal display.

* * * * *